US011059545B2

(12) United States Patent
Brinkel et al.

(10) Patent No.: US 11,059,545 B2
(45) Date of Patent: Jul. 13, 2021

(54) FLOATING CRYOGENIC HYDROCARBON STORAGE STRUCTURE

(71) Applicant: SINGLE BUOY MOORINGS INC., Marly (CH)

(72) Inventors: Theodorus Johannes Bernardus Brinkel, Bât. Aigue Marine (MC); Wouter Sassen, Bât. Aigue Marine (MC)

(73) Assignee: SINGLE BUOY MOORINGS INC., Marly (CH)

( * ) Notice: Subject to any disclaimer, the term of this patent is extended or adjusted under 35 U.S.C. 154(b) by 15 days.

(21) Appl. No.: 16/472,666

(22) PCT Filed: Dec. 20, 2017

(86) PCT No.: PCT/EP2017/083870
§ 371 (c)(1),
(2) Date: Jun. 21, 2019

(87) PCT Pub. No.: WO2018/115152
PCT Pub. Date: Jun. 28, 2018

(65) Prior Publication Data

US 2019/0359289 A1 Nov. 28, 2019

(30) Foreign Application Priority Data

Dec. 23, 2016 (EP) ..... 16206668

(51) Int. Cl.
*B63B 3/14* (2006.01)
*B63B 25/08* (2006.01)
(Continued)

(52) U.S. Cl.
CPC ..... *B63B 25/16* (2013.01); *B63B 3/14* (2013.01); *F17C 3/00* (2013.01);
(Continued)

(58) Field of Classification Search
CPC ..... B63B 75/00; B63B 3/14; B63B 25/16; B63B 2025/087; B63B 2035/448;
(Continued)

(56) References Cited

U.S. PATENT DOCUMENTS 3,043,256 A 7/1962 Brew et al.
3,414,153 A * 12/1968 Leroux ..... B65D 88/02 220/565
(Continued)

FOREIGN PATENT DOCUMENTS

GB 1175323 A 12/1969
WO 2010059059 A1 5/2010
WO 2013156623 A1 10/2013

OTHER PUBLICATIONS

International Search Report, dated Mar. 28, 2018, from corresponding PCT application No. PCT/EP2017/083870.
(Continued)

*Primary Examiner* — Anthony D Wiest
(74) *Attorney, Agent, or Firm* — Nixon & Vanderhye

(57) ABSTRACT

A floating cryogenic storage structure includes a hull with a center line extending in a length direction and two longitudinal side walls, the structure including at least three spherical storage tanks, two tanks being situated with their midpoints on spaced apart longitudinal positions along a first line extending in the length direction at a first side of the center line and a third tank being situated with its midpoint on a longitudinal position on a second line extending in the length direction at a second side of the center line, and a transverse distance between the first and second lines not larger than a diameter of the tanks and the longitudinal position of the midpoint of the third tank situated between the longitudinal positions of the midpoints of the first and second tanks.

20 Claims, 5 Drawing Sheets

(51) Int. Cl.
*B63B 35/44* (2006.01)
*B63B 25/16* (2006.01)
*F17C 3/00* (2006.01)

(52) U.S. Cl.
CPC ... *B63B 2025/087* (2013.01); *B63B 2035/448* (2013.01); *F17C 2201/0128* (2013.01); *F17C 2201/052* (2013.01); *F17C 2205/013* (2013.01); *F17C 2221/033* (2013.01); *F17C 2223/0161* (2013.01); *F17C 2223/033* (2013.01); *F17C 2270/0105* (2013.01); *F17C 2270/0113* (2013.01)

(58) Field of Classification Search
CPC ..... F17C 3/00; F17C 2201/0128; F17C 2201/052; F17C 2205/013; F17C 2221/033; F17C 2223/0161; F17C 2223/033; F17C 2270/0105; F17C 2270/0113
USPC ..... 114/73, 74 R, 74 T, 74 A
See application file for complete search history.

(56) References Cited

U.S. PATENT DOCUMENTS

| | | | | |
|---|---|---|---|---|
| 3,830,180 | A * | 8/1974 | Bolton | F17C 1/002 114/74 A |
| 2013/0092073 | A1* | 4/2013 | Reines | B63B 25/12 114/74 A |
| 2015/0075216 | A1 | 3/2015 | Van Wijngaarden et al. | |

OTHER PUBLICATIONS

Written Opinion, dated Mar. 28, 2018, from corresponding PCT application No. PCT/EP2017/083870.

* cited by examiner

FLOATING CRYOGENIC HYDROCARBON STORAGE STRUCTURE

FIELD OF THE INVENTION

The invention relates to a floating cryogenic hydrocarbon storage structure having a hull with a center line extending in a length direction and two longitudinal side walls, the structure comprising at least three spherical storage tanks. The invention in particular relates to a floating cryogenic hydrocarbon storage structure with a double side shell hull and having a row of Moss type storage tanks on either side of the center line.

BACKGROUND OF THE INVENTION

Such a floating cryogenic hydrocarbon storage structure is known from WO2013/156623 in which a twin-hull cryogenic LNG Floating Production Storage and Offloading structure (a so-called LNG FPSO) is described that is constructed from two interconnected converted LNG carriers. The LNG carriers each comprise a row of spherical Moss tanks in which liquefied natural gas is stored at temperatures of −163° C. at ambient pressure. A number of LNG tanks has been removed so that a flat topside is formed on which the processing equipment for hydrocarbon processing and for liquefaction is placed. The hulls are interconnected by a relatively wide interconnecting beans structure and the two rows of tanks on each side of the longitudinal center line are separated by a relatively large distance.

The known structure comprises six Moss type tanks and has a capacity of 150.000 $m^3$ LNG. It is based on existing retrofitted LNG carriers and is of relatively wide dimensions. The twin hull construction is less suitable for new built floating structures.

From WO2010/059059 a cryogenic carrier is known comprising a single row of Moss type tanks and sponsons for supporting processing equipment.

It is an object of the invention to provide a floating cryogenic hydrocarbon storage and processing structure that is of compact design and that utilizes reduced amounts of steel. It is also an object to provide a floating cryogenic storage structure based on Moss-type storage tanks with ample space for liquefied gas processing equipment that can be produced at reduced costs.

SUMMARY OF THE INVENTION

Hereto the floating structure according to the invention has two spherical tanks situated with their midpoints on spaced apart longitudinal positions along a first line extending in the length direction at a first side of the center line. A third tank is situated with its midpoint on a longitudinal position on a second line extending in the length direction at a second side of the center line. A transverse distance between the first and second lines is not larger than a diameter of the tanks and the longitudinal position of the midpoint of the third tank is situated between the longitudinal positions of the midpoints of the first and second tanks.

By placing the spherical tanks side by side in a stepped configuration, the width of the hull can be reduced by between 10% and 15% compared to the known arrangement in which the midpoints of the two rows of tanks are at opposed positions on each side of the center line. For a hull of a length of 250 m, a width of 60 m and a height of 40 m, a 6% weight reduction can be achieved corresponding to about 3000 tons of steel.

The midpoints of the two rows of tanks may be spaced in the transverse direction at a distance corresponding to the diameter of the spherical tanks or at smaller distances, so that the footprint of the two rows of tanks can be smaller than twice the tank diameter.

In one embodiment of a floating cryogenic storage structure according to the invention, the first and second lines are spaced at a predetermined transverse distance from a respective nearest sidewalk a predetermined minimal clearance being provided between third tank and. the first and second tanks, wherein a transverse distance between the longitudinal side walls of the hull is smaller by at least 5% compared to the transverse distance for the arrangement in which the midpoints of the first and third tanks are on the same transverse line at a corresponding minimal clearance and at a corresponding transverse distance of the lines from the side walls.

By the stepped configuration, the spherical tanks are placed within a compact footprint with a sufficient clearance between the tanks for access and maintenance.

Preferably, at least two tanks are situated along the first and second lines respectively, preferably at least three tanks being situated along at least one of the lines. The liquefied gas FPSO may comprise two rows of five tanks each and may have a width of 78 m and a length of 340 m.

In another embodiment of a floating cryogenic storage structure according to the invention, on a first side of the longitudinal center line a first non-spherical tank is provided adjacent the rearmost spherical tank and on the second side of the longitudinal center line a second non-spherical tank is provided adjacent the front most spherical tank.

In the rectangular tanks, which may be membrane tanks or SPB-type tanks, the different types of hydrocarbon fluid that are separated from the gaseous hydrocarbon feed gas may be stored. The hydrocarbon fluid tanks can be situated in the space at the start and at the end of the two stepped rows of spherical tanks, so that the overall length of the FPSO is not increased.

A bulkhead may extend vertically from a bottom of the vessel towards the deck, the bulkhead extending in the length direction in an undulating manner at a substantially uniform distance from the tanks. In this way, the bulkhead provides a longitudinal reinforcement of the hull structure while accommodating the stepped tank configuration.

In a further embodiment, each tank is surrounded by bulkhead sections arranged in a hexagonal pattern. In this manner, the tanks are thermally insulated from each other, and maintenance or inspection may be carried on an empty tank while the bulkheads provide for proper separation from the surrounding parts of the hull.

In another embodiment, the sidewalk extend from a bottom to an upper deck level. The spherical tanks extend below deck level. A longitudinal beam extends along the center line of the hull between the two rows of spherical tanks. The deck space can be utilized for supporting process equipment over the tanks, the tops of which may located just below, at or above deck level. The longitudinal beam reinforces the overhead deck and fits in the top open space between the adjacent spherical tanks.

BRIEF DESCRIPTION OF THE DRAWINGS

Some embodiments of a floating cryogenic storage and processing structure according to the invention, will by way of non-limiting example be described in detail with reference to the accompanying drawings. In the drawings.

DETAILED DESCRIPTION OF THE INVENTION

Figure 1:
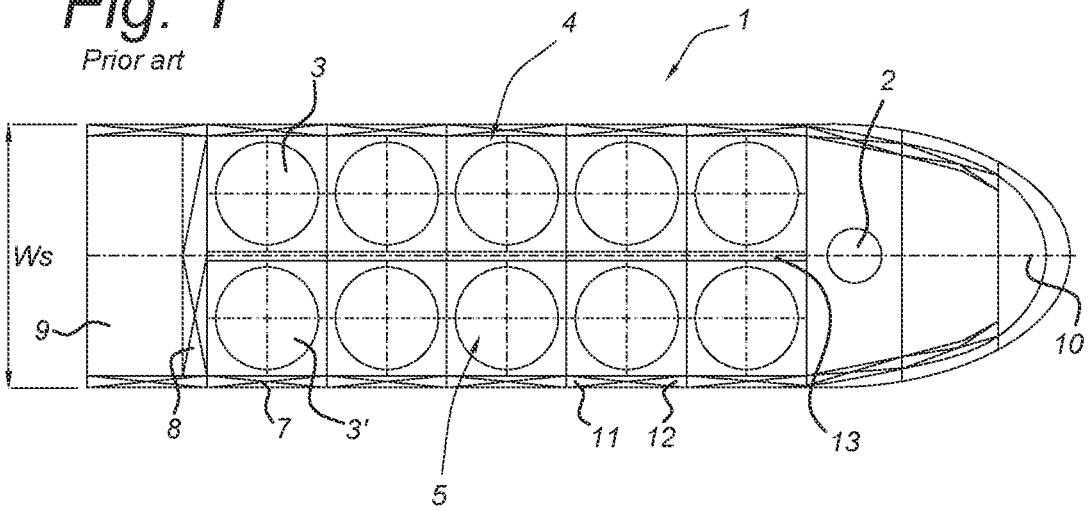
Fig. 1 Prior art
FIG. 1 shows a plan view of a LNG FPSO known in the prior art, having two spaced-apart rows of spherical Moss tanks.

FIG. 1 shows a floating cryogenic LNG production, storage and offloading (FPSO) structure 1 comprising a hull 9 that is anchored to the sea bed via a turret 2. The IPSO 1 can weathervane around the turret 2 to be aligned with the prevailing direction of winds and/or currents.

Figure 2:
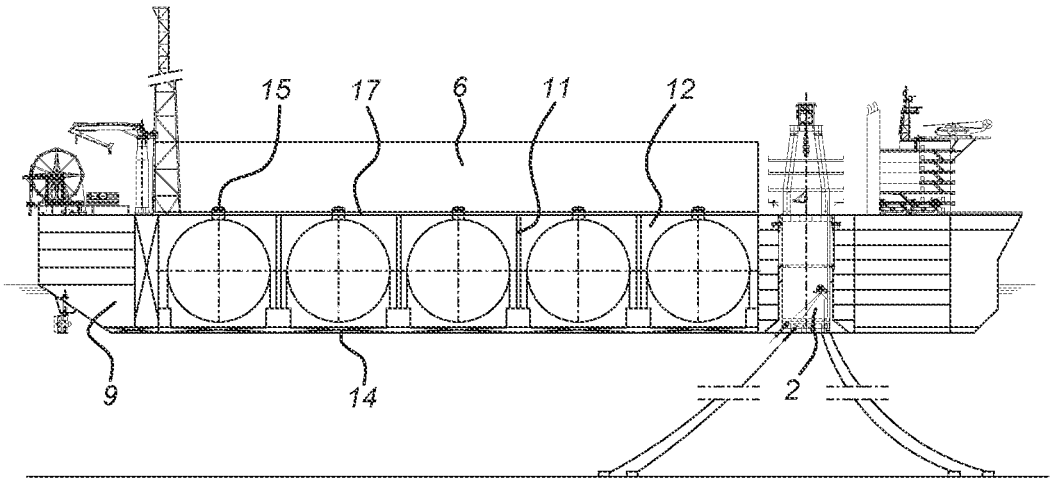
Fig. 2 Prior art
FIG. 2 shows a longitudinal cross-sectional view of the known FPSO of FIG. 1.
Figure 3:
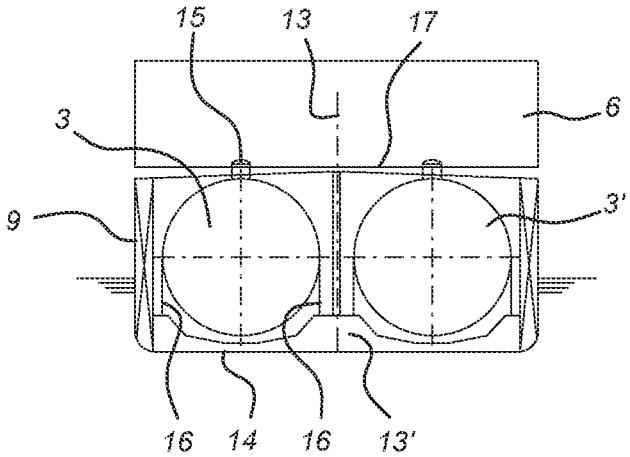
Fig. 3 Prior art
FIG. 3 shows a transverse cross-sectional view of the FPSO of FIG. 1.

On board of the vessel 1, spherical Moss type tanks 3, 3' are arranged in two parallel rows 4, 5. Process equipment for gas treatment and for liquefaction of the treated natural gas is situated on deck of the vessel 1 on topside 6 (see FIG. 2). The process equipment purifies the natural gas that is produced from a subsea well by removal of water, carbon dioxide and $H_2S$ from the natural gas. The liquid hydrocarbon components that are separated from the gas, or "condensate" are stored in tanks 8. Next, the treated gas is liquefied by cooling to about −163° C. and is stored in liquid state at about ambient pressure in the insulated spherical Moss type tanks 3, 3'. The tanks 3, 3' are placed at respective sides of the longitudinal center line 10 and are separated by a vertical longitudinal bulkhead 13 on the center girder 13' in the double bottom 14 (see FIG. 3) and by transverse bulkheads 11, 12.

The tanks 3, 3' have their upper ends or "domes" 15 situated near deck level 17, so that the tanks can be easily filled and emptied from the deck 17. At the bottom 14, the tanks 3, 3' are supported by a tank support structure or skirt 16 resting on the double bottom 14. and fixing the spherical tanks in place.

Figure 4:
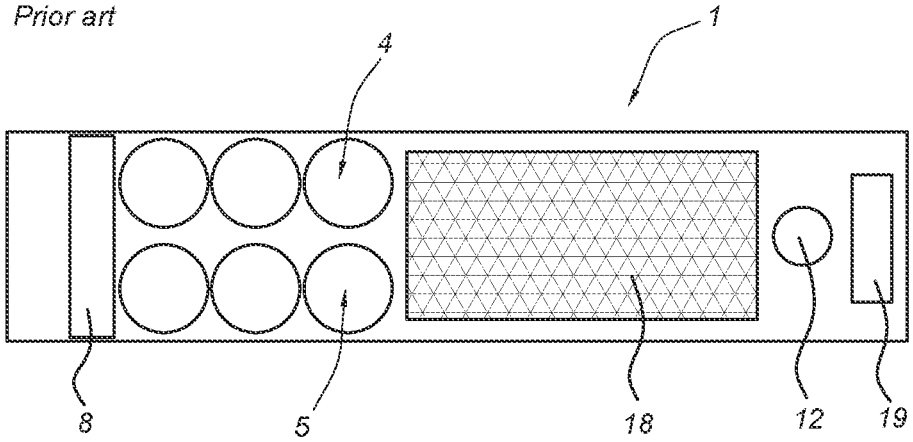
Fig. 4 Prior art
FIG. 4 shows a schematic plan view of a known double row FPSO having a processing deck at a longitudinal distance from the spherical tanks.

FIG. 4 schematically shows a known embodiment of an LNG FPSO 1, having a deck 18 supporting gas treatment equipment and a liquefaction plant situated in front of the two rows of spherical tanks 4, 5.

Figure 5:
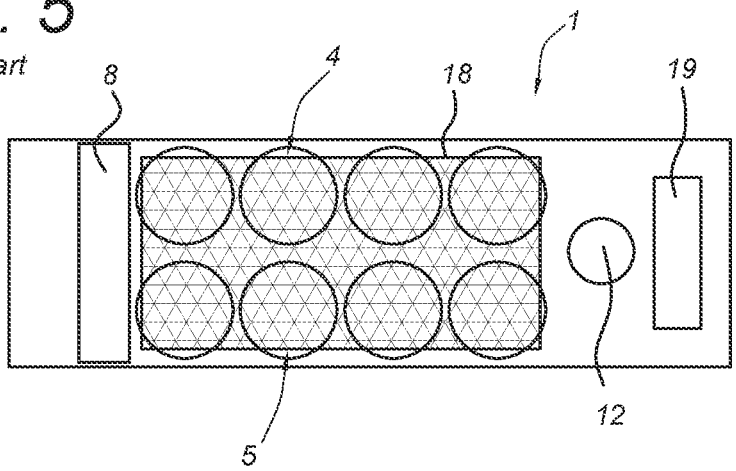
Fig. 5 Prior art
FIG. 5 shows a schematic plan view of a known double row FPSO having a topside overlying the spherical tanks.

FIG. 5 shows a known arrangement in which the process equipment deck 18 is placed over the rows of tanks 4,5, resulting in a smaller length of the vessel. Condensate is stored in aft tanks 8. Near the bow an accommodation block 19 is provided.

All embodiments shown in FIGS. 1-5 can be adapted to be equipped with the stepped storage tank configuration according to the invention and described in detail here below.

Figure 6:
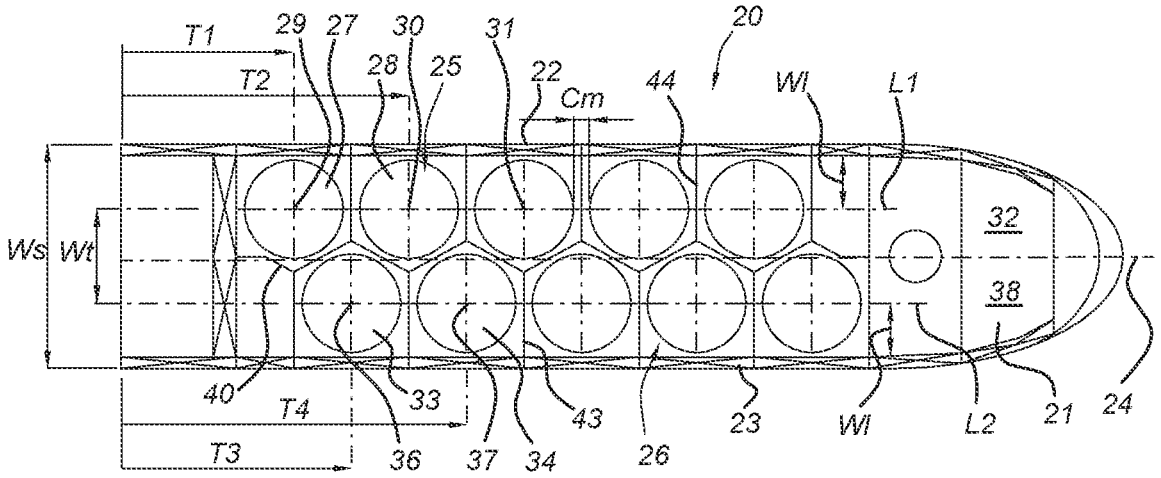
FIG. 6 shows a plan view of an embodiment of an LNG FPSO according to the invention, having two stepped rows of spherical Moss tanks.

FIG. 6 shows an LNG FPSO 20 according to the invention having a hull 21 with longitudinal sides 22, 23. On each side of the longitudinal center line 24, two rows of spherical Moss type tanks 25, 26 are placed. Tanks 27, 28 of row 25 are placed with their midpoints 29, 30 on a first line L1 on a first side 32 of the center line 24. Tanks 33, 34 are placed with their midpoints 36, 37 on the line L2 on a second side 38 of the center line 24. The midpoints 29, 30 of tanks 27, 28 on side 32 are situated at longitudinal distances T1, T2 along the line L1. The midpoints 36, 37 of tanks 33, 34 on the opposite side 38 are situated halfway between the midpoints 29, 30, 31 at longitudinal distances T3, T4 along second line L2. The lines L1,L2 are spaced at a distance W1 from the sides 22,23, such that a clearance is present between the tanks and the sides.

The distance Wt between the lines L1, L2 is less than the diameter D of the tanks. In the embodiment of FIG. 1, Wt is larger than the tank diameter D. A minimal clearance Cm is present between adjacent tanks so that each tank is separated from its neighbouring tank by an insulating wall, and access to a tank is possible from all sides.

By the stepped pattern of the spherical tanks according to the invention, the width Ws of the cargo section of the FPSO 20 can be reduced by between 10% and 15% compared to the prior art configuration shown in FIG. 1. As a result, at a length of the hull of 250 m, a width of 60 m and a depth of 40 m, the amount of steel used for the construction can be reduced from about 48,000 tonnes to about 45,000 tonnes.

FIG. 6 shows a central bulk head 40 extending in a meandering manner in the direction of the longitudinal center line 24 between the two rows of tanks 25, 26. The bulkhead 40 interconnects the deck structure 41 and the bottom 42 and forms a compartmentalizing construction for the hull of the FPSO 20. Transverse bulkhead sections 43, 44 extend between adjacent tanks, from the vessel sidewalls 22, 23 in a transverse direction towards the central bulk head 40 so that the spherical tanks are contained in a hexagonal pattern in isolated compartments.

Figure 7:
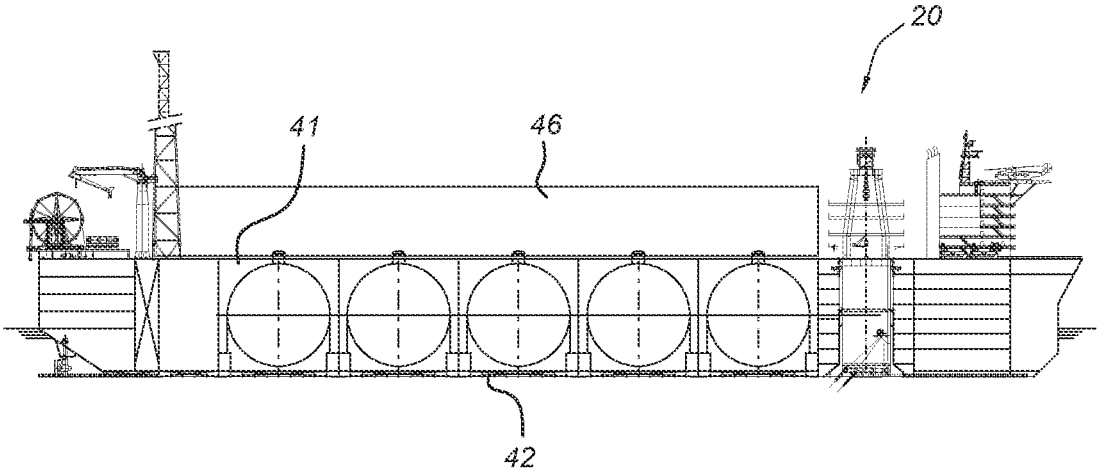
FIG. 7 shows a longitudinal cross-sectional view of the FPSO of FIG. 6.

FIG. 7 shows a topside 46 placed on top of the tanks that are located below the deck structure 41, the topside supporting the processing and liquefaction equipment.

Figure 8:
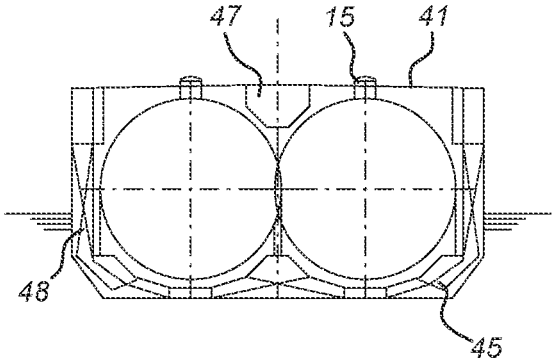
FIG. 8 shows a transverse cross-sectional view of the FPSO of FIG. 6.

FIG. 8 shows a box girder 47 that extends along the longitudinal center line 24 and reinforces the deck structure 41. The spherical tanks are placed in a support structure 45 in a hexagonal pattern. The support structure 45 may form ballast tanks 48 for taking in of sea water.

Figure 9:
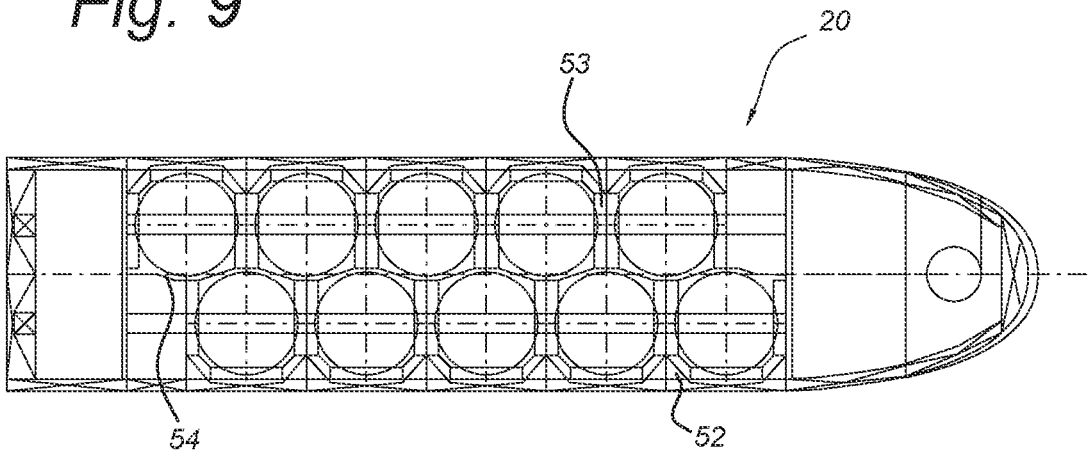
FIG. 9 shows a plan view of another embodiment of an LNG FPSO according to the invention.

FIG. 9 shows in more detail an FPSO according to the invention where the tanks are placed between side supports 52 extending from the hull of the vessel, the transverse bulkheads 53 and the central bulkhead 54.

Figure 10:
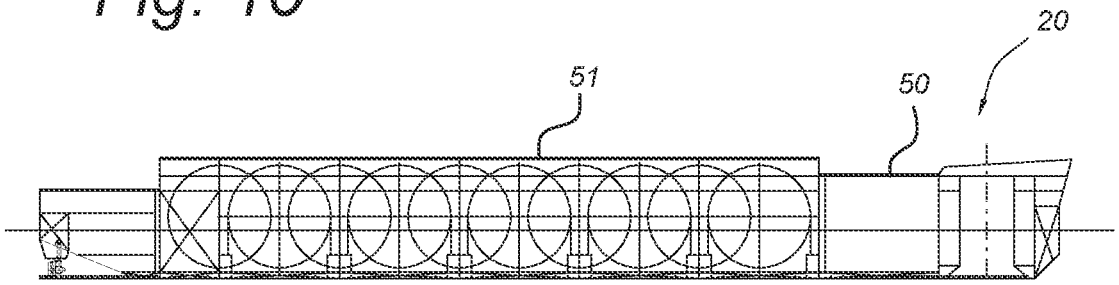
FIG. 10 shows a longitudinal cross-sectional view of the LNG FPSO of FIG. 9.

In FIG. 10 it can be seen that the tanks and the topside level 51 extend slightly above the level of fore and aft deck 50.

Figure 11:
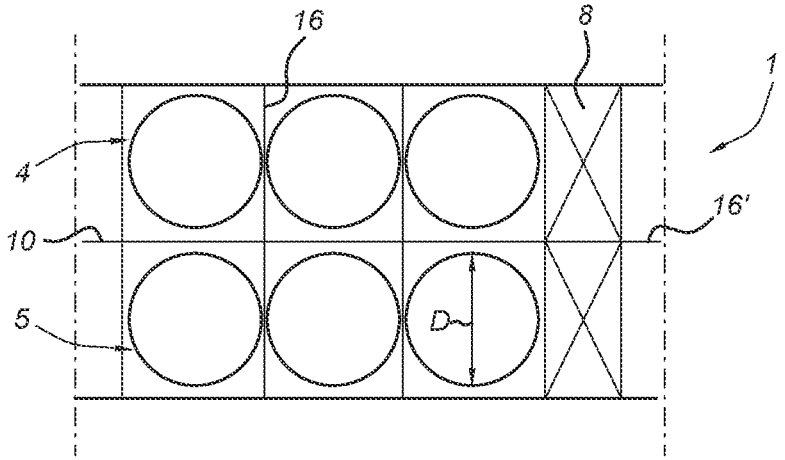
Fig. 11 Prior art
FIG. 11 shows a schematic view of the width of a known double row configuration of spherical tanks.

FIG. 11 schematically shows a known arrangement of two rows 4, 5 of spherical Moss tanks with a diameter D arranged with their midpoints at opposite positions of the longitudinal center line 10. The tanks are confined within individual compartments formed by transverse bulkheads 16 and longitudinal bulkhead 16'. Condensate tanks 8 are situated in a fore position.

Figure 12:
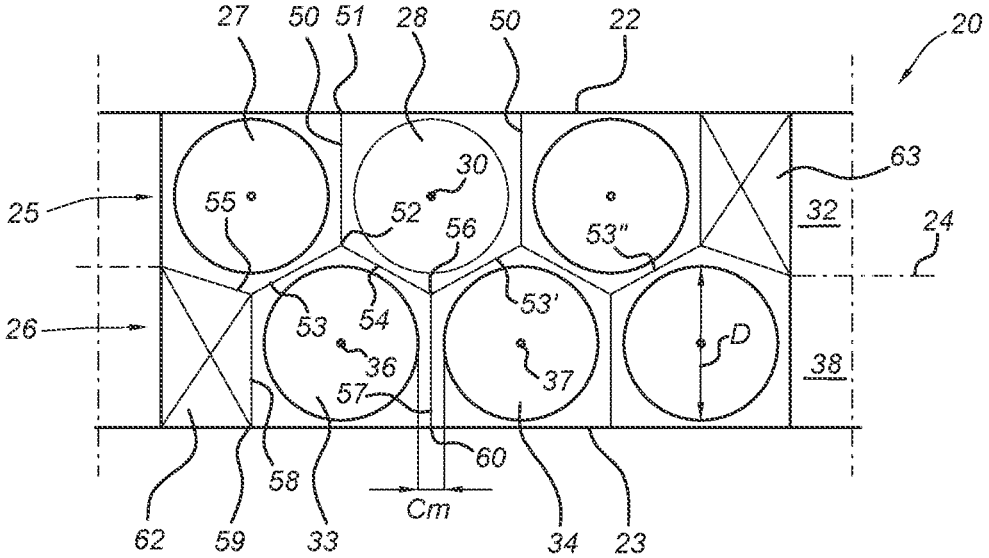
FIG. 12 shows a schematic of the reduction in width obtained by a hexagonal configuration of spherical tanks according to the invention.

FIG. 12 shows the compact stepped arrangement according to the invention of the two rows 25, 26 of spherical tanks 27,28,33,34 of the same diameter D, arranged in a hexagonal pattern at a mutual minimum clearance Cm. Each tank is confined in an individual compartment formed by a first transverse bulkhead section 50 extending from longitudinal side position 51 between tanks 27, 28 on side 32 of the longitudinal center line 24. At first branch point 52, two bulkhead mid-sections 53, 54 connect to the transverse section 50, extending at an angle and connecting to transverse bulkhead sections 57, 58 on either side of tank 33. The transverse bulkhead sections 57,58 connect to second side 23 at side positions 59, 60. Condensate tanks 62, 63 are situated fore and aft of the stepped rows of tanks 25, 26.

In an embodiment, bulkhead mid sections 53,53', 53" of the central bulkhead may be omitted to allow for different sizes of storage tanks. When re-using tanks from existing LNG carriers, the storage tanks may not all be of the same size and can be accommodated in the stepped arrangement according to the invention.

The invention claimed is:

1. Floating cryogenic storage structure (20) comprising a hull (9) with a center line (24) extending in a length direction and two longitudinal side walls (22,23), the structure comprising at least three spherical storage tanks (27,28,33,34), two tanks (27,28) being situated with their midpoints (29,30) on spaced apart longitudinal positions (T1,T2) along a first line (L1) extending in the length direction at a first side (32) of the center line (24) and a third tank (33) being situated with its midpoint (36) on a longitudinal position (T3) on a second line (L2) extending in the length direction at a second side (38) of the center line, wherein a transverse distance (Wt) between the first and second lines (L1,L2) is not larger than a diameter (D) of the tanks and the longitudinal position (T3) of the midpoint of the third tank (36) is situated between the longitudinal positions (T1,T2) of the midpoints of the first and second tanks.

2. Floating cryogenic storage structure (20) according to claim 1, wherein the transverse distance (Wt) between the first and second lines (L1,L2) is smaller than the diameter (D) of the tanks (27,28,33,34).

3. Floating cryogenic storage structure (20) according to claim 2, the first and second lines (L1,L2) being spaced at a predetermined transverse distance (W1) from a respective nearest sidewall (22,23), a predetermined minimal clearance (Cm) being provided between third tank (33) and the first and second tanks (27,28), wherein a transverse distance (Ws) between the longitudinal side walls (22,23) is smaller by at least 5% compared to a transverse distance for an arrangement of tanks having equal diameters in which midpoints of the first and third tanks are on the same transverse line at a corresponding minimal clearance and at a corresponding transverse distance of the lines from the side walls.

4. Floating cryogenic storage structure (20) according to claim 2, wherein the longitudinal position (T3) of the midpoint (36) of the third tank (33) is situated midway between the longitudinal positions (T1,T2) of the midpoints (29,30) of the first and second tanks (27,28).

5. Floating cryogenic storage structure (20) according to claim 2, wherein at least two storage tanks (33,34) are situated with their midpoints (36,37) along the second line (L2) at a mutual distance corresponding to the distance between the midpoints (29,30) of the first and second tanks (27,28).

6. Floating cryogenic storage structure (20) according to claim 1, the first and second lines (L1,L2) being spaced at a predetermined transverse distance (W1) from a respective nearest sidewall (22,23), a predetermined minimal clearance (Cm) being provided between third tank (33) and the first and second tanks (27,28), wherein a transverse distance (Ws) between the longitudinal side walls (22,23) is smaller by at least 5% compared to a transverse distance for an arrangement of tanks having equal diameters in which midpoints of the first and third tanks are on the same transverse line at a corresponding minimal clearance and at a corresponding transverse distance of the lines from the side walls.

7. Floating cryogenic storage structure (20) according to claims 6, wherein the longitudinal position (T3) of the midpoint (36) of the third tank (33) is situated midway between the longitudinal positions (T1,T2) of the midpoints (29,30) of the first and second tanks (27,28).

8. Floating cryogenic storage structure (20) according to claim 6, wherein at least two storage tanks (33,34) are situated with their midpoints (36,37) along the second line (L2) at a mutual distance corresponding to the distance between the midpoints (29,30) of the first and second tanks (27,28).

9. Floating cryogenic storage structure (20) according to claim 1, wherein the longitudinal position (T3) of the midpoint (36) of the third tank (33) is situated midway between the longitudinal positions (T1,T2) of the midpoints (29,30) of the first and second tanks (27,28).

10. Floating cryogenic storage structure (20) according to claim 1, wherein at least two storage tanks (33,34) are situated with their midpoints (36,37) along the second line (L2) at a mutual distance corresponding to the distance between the midpoints (29,30) of the first and second tanks (27,28).

11. Floating cryogenic storage structure (20) according to claim 1, wherein at least two tanks (27,28; 33,34) are situated along the first and second lines (L1,L2) respectively.

12. Floating cryogenic storage structure (20) according to claim 1, wherein on a first side (32) of the longitudinal center line (24) a first non-spherical tank (63) is provided adjacent the foremost spherical tank and on the second side (38) of the longitudinal center (24) line a second non-spherical tank (62) is provided adjacent the rear most spherical tank (33).

13. Floating cryogenic storage structure (20) according to claim 1, comprising a bulkhead (40) extending vertically from a bottom (42) of the hull (9) towards a deck (41), the bulkhead extending in the length direction in undulating manner at a substantially uniform distance from the tanks.

14. Floating cryogenic storage structure (20) according to claim 13, the bulkhead (40) having a first transverse section (50) extending transversely between the first and second storage tanks (27,28) from a first side position (51) in the direction of the midpoint (36) of the third storage tank (33) to a first branch positon (52) on the first side (32) of the structure, at least one mid-section (53,54) extending obliquely to a second branch position (55,56) on one side of the third storage tank (33) on the second side (38) of the structure, and at least one second transverse section (57,58) extending from the respective second branch position (55, 56) to a second side position (59,60) of the vessel.

15. Floating cryogenic storage structure (20) according to claim 14, comprising two mid sections (53,54), each extending obliquely to respectively the second and a third branch position (55,56) on each side of the third storage tank (33) on the second side (38) of the structure, and on each side of the third storage tank (33) respectively, the second and a third transverse sections (57,58) extending from the respective second and the third branch position (55,56) to the second and third side positions (59,60) of the structure.

16. Floating cryogenic storage structure (20) according to claim 13, each tank being surrounded by bulkhead sections arranged in a hexagonal pattern.

17. Floating cryogenic storage structure (20) according to claim 1, the sidewalls (22,23) extending from a bottom (42) to a deck level (41), a top of the spherical tanks extending near deck level, a longitudinal beam (47) extending along the center line (24) between the two rows (25,26) of spherical tanks.

18. Floating cryogenic storage structure (20) according to claim 17, wherein a substantially horizontal deck structure (43,51) extends over the top of the spherical tanks, the deck structure being supported by the beam (47) and carrying process equipment.

19. Floating cryogenic storage structure (20) according to claim 1, the sidewalls (22,23) extending from a bottom (42) to a deck level (41), a top of the spherical tanks extending below deck level, a longitudinal beam (47) extending along the center line (24) between the two rows (25,26) of spherical tanks.

20. Floating cryogenic storage structure (20) according to claim 1, wherein at least two tanks (27,28; 33,34) are situated along the first and second lines (L1,L2) respectively, with at least three tanks being situated along at least one of the lines.

* * * * *